US008418950B2

(12) United States Patent
Hagleitner

(10) Patent No.: US 8,418,950 B2
(45) Date of Patent: Apr. 16, 2013

(54) PAPER DISPENSER

(76) Inventor: Hans Georg Hagleitner, Zell am See (AT)

( * ) Notice: Subject to any disclaimer, the term of this patent is extended or adjusted under 35 U.S.C. 154(b) by 23 days.

(21) Appl. No.: 12/940,588

(22) Filed: Nov. 5, 2010

(65) Prior Publication Data

US 2011/0095127 A1 Apr. 28, 2011

Related U.S. Application Data

(63) Continuation of application No. PCT/AT2009/000186, filed on May 4, 2009.

(30) Foreign Application Priority Data

May 5, 2008 (AT) ..... A 703/2008

(51) Int. Cl.
*B65H 19/10* (2006.01)

(52) U.S. Cl.
USPC ..... 242/560.3; 242/559

(58) Field of Classification Search ..... 242/558, 242/559, 559.1, 561, 598.6, 559.3, 559.4, 242/560, 560.1, 560.2, 560.3
See application file for complete search history.

(56) References Cited

U.S. PATENT DOCUMENTS

| | | | | |
|---|---|---|---|---|
| 4,844,361 | A | 7/1989 | Granger | |
| 4,944,466 | A | 7/1990 | Jespersen | |
| 5,244,161 | A | 9/1993 | Wirtz-Odenthal | |
| 5,271,574 | A * | 12/1993 | Formon et al. | 242/560.3 |
| 5,288,032 | A * | 2/1994 | Boone et al. | 242/560.3 |
| 5,558,302 | A | 9/1996 | Jesperson | |
| 7,338,007 | B2 * | 3/2008 | Valot | 242/559 |
| 7,832,678 | B2 * | 11/2010 | Hjort et al. | 242/560.3 |
| 7,980,506 | B2 * | 7/2011 | Kling et al. | 242/560 |

FOREIGN PATENT DOCUMENTS

| | | |
|---|---|---|
| WO | 90/00512 A1 | 1/1990 |
| WO | 9111946 A1 | 8/1991 |
| WO | 96/24548 A1 | 8/1996 |

OTHER PUBLICATIONS

International Search Report dated Mar. 9, 2011.

* cited by examiner

*Primary Examiner* — William A Rivera

(74) *Attorney, Agent, or Firm* — Laurence A. Greenberg; Werner H. Stemer; Ralph E. Locher

(57) ABSTRACT

A paper dispenser contains a receiving compartment for a dispenser roll, a transport path leading from above into the receiving compartment, a hold position for a spare roll being defined in the transport path by a blocking device, and a transfer device for the paper of the spare roll once the paper of the dispenser roll is used up. The width of the receiving compartment is smaller than the diameter of the spare roll, and a sensor element for the diameter of the spare roll releases the blocking device not before the diameter of the spare roll has been reduced to the width of the receiving compartment.

10 Claims, 8 Drawing Sheets

PAPER DISPENSER

CROSS-REFERENCE TO RELATED APPLICATION

This is a continuation application, under 35 U.S.C. §120, of copending international application No. PCT/AT2009/000186, filed May 4, 2009, which designated the United States; this application also claims the priority, under 35 U.S.C. §119, of Austrian patent application No. A 703/2008, filed May 5, 2008; the prior applications are herewith incorporated by reference in their entirety.

BACKGROUND OF THE INVENTION

Field of the Invention

The invention relates to paper dispensers having a housing, in which the following are provided: a receiving compartment for a dispenser roll, a guide track leading from above into the receiving compartment for a spare roll that can move from an upper waiting position into the receiving compartment, and a device for transferring the paper from the spare roll, which is dispensed once the dispenser roll has been used up.

A paper dispenser of this type is known, for example from U.S. Pat. No. 4,844,361. There, the diameter of the dispenser roll is monitored and, when a minimum diameter of the dispenser roll is determined, a blocking device for the waiting position is released. As a result, the spare roll is transferred downward into the dispensing position, so that further paper can be drawn off this roll and a new spare roll can be inserted from above at some time before the spare roll is used up. This requires a dispenser housing in the lower dispensing part of which there is space for a full diameter roll. As a result, the housings become relatively voluminous, in particular when cutting devices, electric drives, battery compartments or further internal fittings are intended to be present.

SUMMARY OF THE INVENTION

It is accordingly an object of the invention to provide a paper dispenser which overcomes the above-mentioned disadvantages of the prior art devices of this general type.

With the foregoing and other objects in view there is provided, in accordance with the invention a paper dispenser for dispensing paper. The paper dispenser contains a housing, a receiving compartment for a dispenser roll disposed in the housing, and a guide track leading from above into the receiving compartment for a spare roll that can move from an upper waiting position into the receiving compartment. The guide track is disposed in the housing. A device is disposed in the housing for transferring the paper from the spare roll, which is dispensed once the dispenser roll has been used up. A waiting position is delimited by a narrow passage through which the spare roll can move into the receiving compartment only when the spare roll has a reduced diameter. The narrow passage is disposed in the housing.

The invention has now recognized that the width of the receiving compartment for the dispenser roll can be smaller than the diameter of the spare roll if the waiting position is delimited by a narrow passage, through which the spare roll can move into the receiving compartment only when the roll has a reduced diameter. The reduced width of the receiving compartment also means that the height is reduced, so that space is created for additional constituent parts of the dispenser. The starting point is the thought that refilling is not carried out anyway immediately after the dispenser roll has been used up but at a time interval thereafter and during this time period it is naturally of no importance whether the new roll is lying in a lower dispensing position or still in the upper waiting position of the spare roll.

The narrow passage can be formed between the guide track and a housing part, for example the rear wall of the latter, i.e. the spare roll rests with the circumference on the rear wall and cannot fall down, since the guide track is narrower than the diameter of the spare roll or because, in the case of rolls which are provided with bearing journals projecting at the ends, which slide or fall in groove-like guide tracks, the bearing journals are still at a distance from the section leading downward. If the spare roll is gradually used up, then the diameter of the spare roll or the distance of the bearing journals from the section of the guide track leading downward decreases. For instance, after half has been used up, that diameter which allows the spare roll to slip downward can then be reached.

Since the paper rolls are normally neither dimensionally accurate nor exactly cylindrical, it is possible for the cross-sectional area of the roll not to be circular but slightly elliptical, so that the roll jams as it slips down or moves down, or the two bearing journals do not enter synchronously into the groove sections leading downward.

In order to avoid faults caused as a result, a preferred embodiment provides for a blocking device to be provided in the narrow passage, which is released only when the diameter of the spare roll has been reduced below the width of the narrow passage.

For the registration of this once more somewhat smaller diameter of the spare roll, the latter is preferably directly or indirectly assigned a movable sensing element. In a first embodiment, the direct diameter registration can be carried out by the movable sensing element resting on the circumferential surface of the spare roll.

In a further embodiment, the diameter registration is carried out indirectly by sensing the migration of the roll axis, in particular of the bearing journal along the initial section of the guide track, which takes place as a function of the reduction in the diameter. For instance, a pivotable sensing element can rest on the bearing journal and, after the appropriate distance has been reached, can fall away, the blocking device being unlocked mechanically.

This can be done, for example, by the pivoting movement of the sensing element being converted into a linear movement of the blocking device which, in this case, is formed in particular by a slide, the end of which projects into the guide track.

In a second embodiment, provision can be made for the blocking element provided to be a swinging arm that can be moved downward, the end of which projects into the guide track and is released by the moving sensing element.

If the paper dispenser according to the invention has a lid that can be pivoted up, provision is preferably made in a further embodiment for the sensing element also to pivot upward therewith, in order to be able to insert the spare roll more easily. When the lid is closed, the sensing element also falls down again and rests on the inserted spare roll.

A further preferred embodiment of a paper dispenser having a receiving compartment for a dispenser roll, having a guide track leading from above into the receiving compartment, in which track a waiting position, defined by a blocking device, for a spare roll is provided, and having a device for transferring the paper from the spare roll after the paper from the dispenser roll has been used up, is characterized in that the width of the receiving compartment is smaller than the diameter of the spare roll, and a sensing element for the diameter of the spare roll is provided, which releases the blocking device only when the diameter of the spare roll has been reduced to the width of the receiving compartment.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
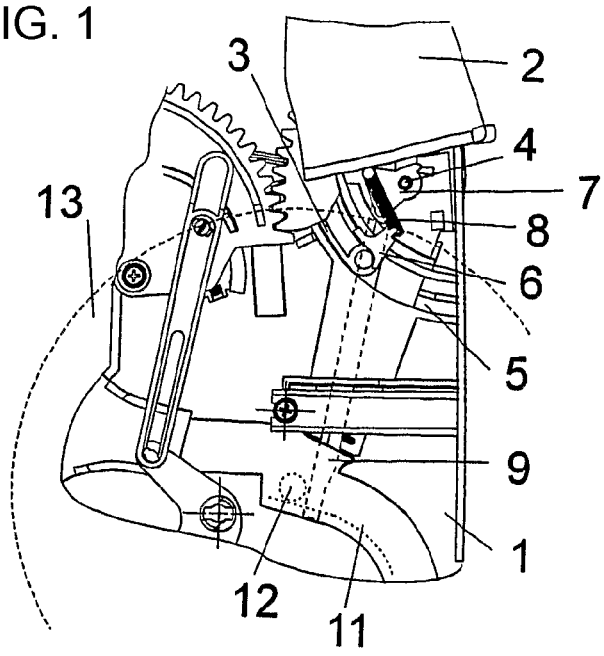
FIG. 1 is a diagrammatic, side view of an upper region of a paper dispenser with a lid open according to the invention.
Figure 2:
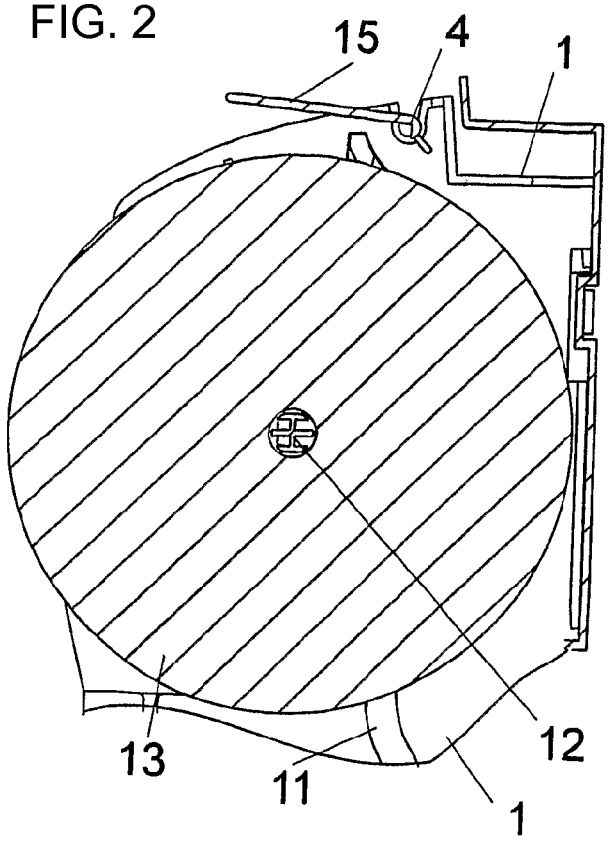
FIG. 2 is a diagrammatic, longitudinal sectional view through the paper dispenser according to FIG. 1.
Figure 6:
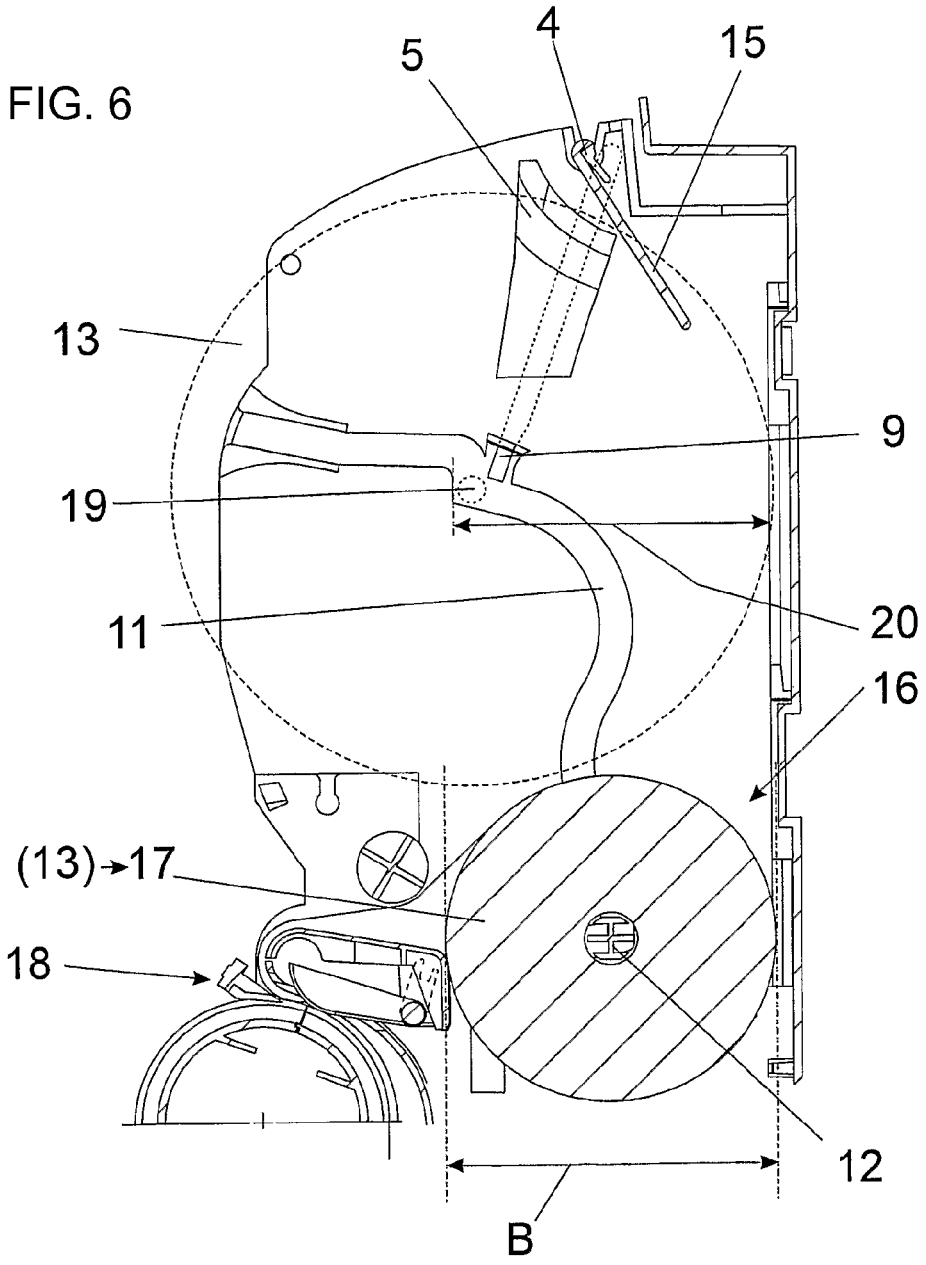
FIG. 6 is a diagrammatic, longitudinal sectional view through the paper dispenser with a blocking device drawn up completely and a spare roll that has fallen downward.

Referring now to the figures of the drawing in detail and first, particularly, to FIGS. 1 and 6 thereof, there is shown a dispenser for paper from a dispenser roll 17 that has in a housing 1 an upper receiving compartment for a spare roll 13, which is accessible after a lid 2 has been pivoted up. The dispenser has mutually opposite guide tracks 11 in the form of side wall grooves, in which bearing journals 19 projecting from roll carriers 12 at the ends engage. As can be seen from FIG. 6 or 8, a full spare roll 13 almost fills the upper part of the dispenser housing 1. Formed in the guide track 11 is a narrow passage 20, which defines a waiting position for the spare roll 13. Provided in the narrow passage 20 is a blocking device 9, which projects with one end into the guide track 11 and can be removed from the latter in order to permit the spare roll 13 to slip or move downward.

Figure 7:
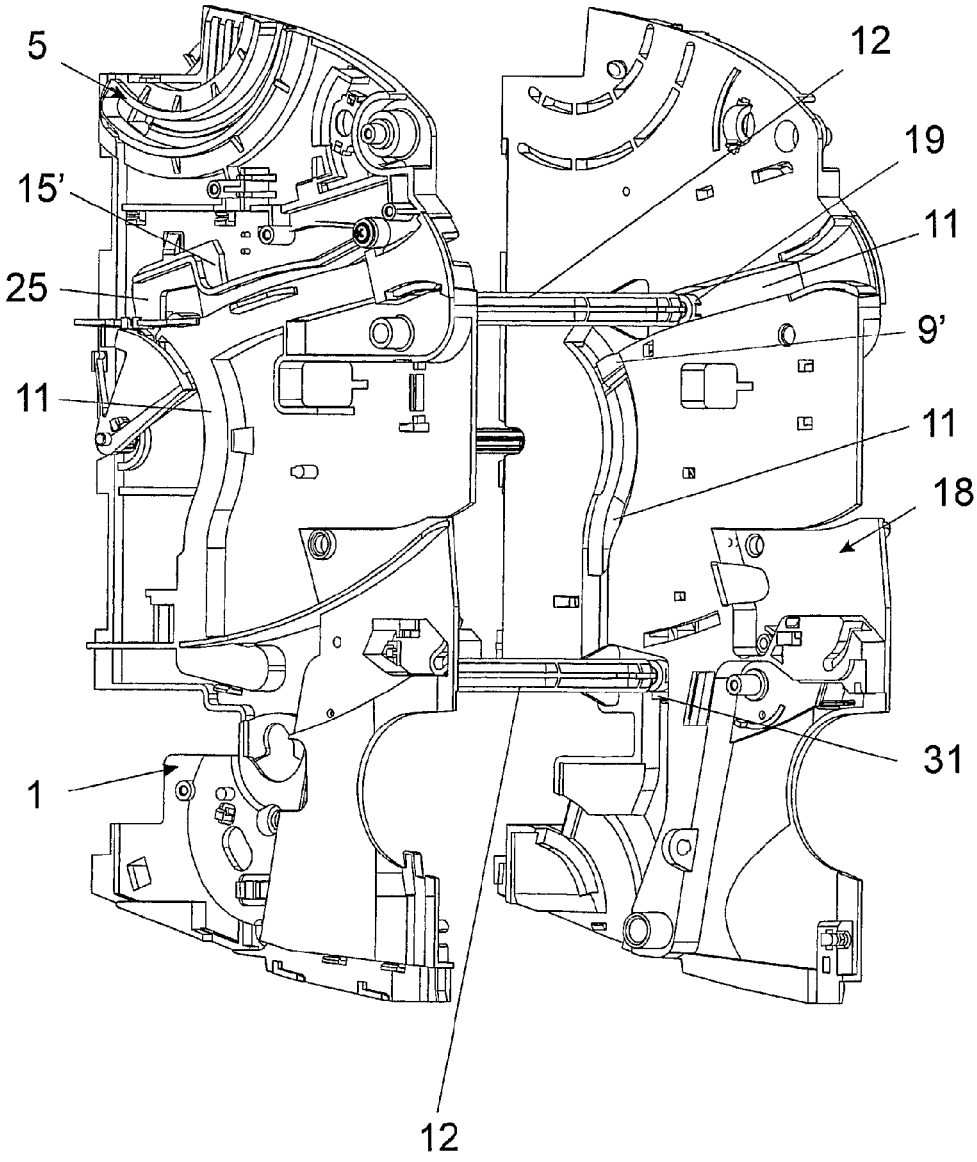
FIG. 7 is a diagrammatic, perspective view of two side walls of a second embodiment of a paper dispenser having a roll carrier in the dispensing position and a roll carrier in the waiting position.

Provided in the lower part of the dispenser housing 1 is a receiving compartment 16 for the dispenser roll 17, from which the paper web is drawn off, passing through a conveying device, not specifically explained. A width B of the receiving compartment 16, as can be seen from FIG. 6, is substantially smaller than the diameter of a spare roll 13, preferably only about half the width thereof, so that other components of the paper dispenser can be accommodated in the space saved. In order then to be able to continue to remove paper from the dispenser after the paper from the dispenser roll 17 has been used up, a device 18—merely indicated—is provided (FIGS. 6, 7), which feeds the paper start of the spare roll 13 following the end of the dispenser roll 17 to the conveying device, through which the paper web from the spare roll 13 is then drawn down. In the process, the spare roll 13 first remains in the waiting position in the upper part, in which, since it cannot pass through the narrow passage 20, it rests on the rear wall of the housing 1, and in which the bearing journals 19 of the roll carrier 12 are prevented from moving by the blocking device 9.

Figure 3:
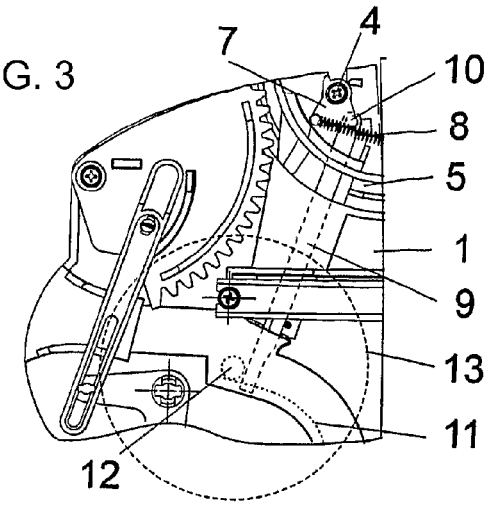
FIG. 3 is a diagrammatic, side view of the upper region with a spare roll that has already been largely reduced in size.
Figure 4:
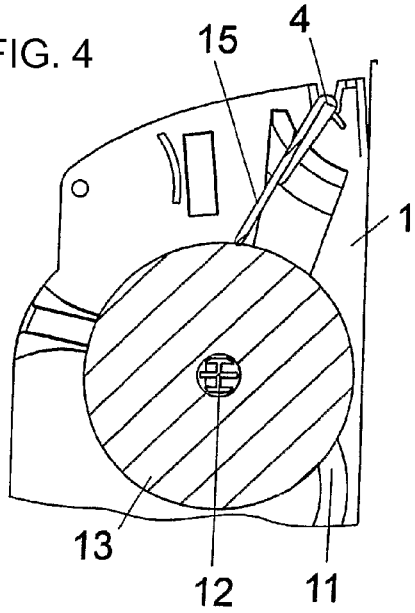
FIG. 4 is a diagrammatic, longitudinal sectional view through the paper dispenser according to FIG. 3.
Figure 5:
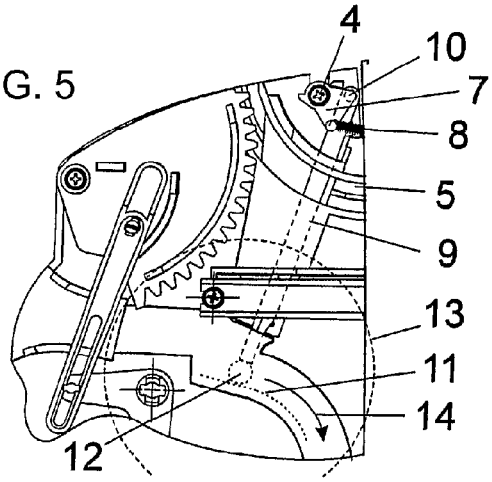
FIG. 5 is a diagrammatic, side view of the upper region showing a waiting position for a spare roll unlocked.

In the embodiment according to FIGS. 1 to 6, a sensing element 15 in the form of a pivoting bow or the like, which is dynamically coupled to the blocking device 9, rests on the spare roll 13. FIGS. 1, 3, and 5 reveal that on the pivot axis 4 that bears the sensing element 15 there is provided an approximately triangular control part 7, to which the upper end of the blocking device 9 is attached at a distance from a pivot axis 4. A hinge pin 10 thus moves on a circular arc, since the sensing element 15 pivots downward when the diameter of the spare roll 13 becomes smaller. The arrangement is made in such a way that, at the start of the pivoting movement of the sensing element 15, the hinge pin 10 moves over an angle of about 60° on a "horizontal" curve, i.e. that the end in the guide track 11 does not release the spare roll over this range, since the directional component directed upward is small.

FIGS. 3 and 4 show the position of the sensing element 15 and of the blocking device 9 shortly before the spare roll 13 has been used up to such an extent that the diameter thereof has been reduced to the width B of the receiving compartment 16 and the spare roll can be transferred downward. The sensing element 15 is still just lying on the spare roll 13 and—as soon as some more paper has been drawn off—will pivot through into the release position for the blocking device 9, as can be seen from FIG. 6. As the sensing element 15 pivots through, the hinge pin 10 pivots outward on a steeply rising curve since, over this angular range, the lifting component has become substantially greater and the blocking device 9 is drawn up. The remaining part of the spare roll 13, the diameter of which is now minimally smaller than the width B of the receiving compartment 16, can then fall or slip downward without jamming, so that it continues to function as a new dispenser roll 17. Then, until the new dispenser roll 17 has been used up, a spare roll can be put in at the top. Hooked into the control part 7 is a tension spring 8, the other end of which is fixed to a spring holder 6, so that the sensing element 15 is pressed onto the spare roll 13. In order to make it easier to insert the new spare roll, the spring holder 6 is not fixed to the housing 1 but to a curved extension 3 of the lid 2, which slides in a pivoting guide 5 of the housing 1. As the lid 2 is pivoted, the tension spring 8 is therefore relieved of tension, since the spring holder 6 is moved concomitantly, and the sensing element 15 is likewise moved upward.

Figure 8:
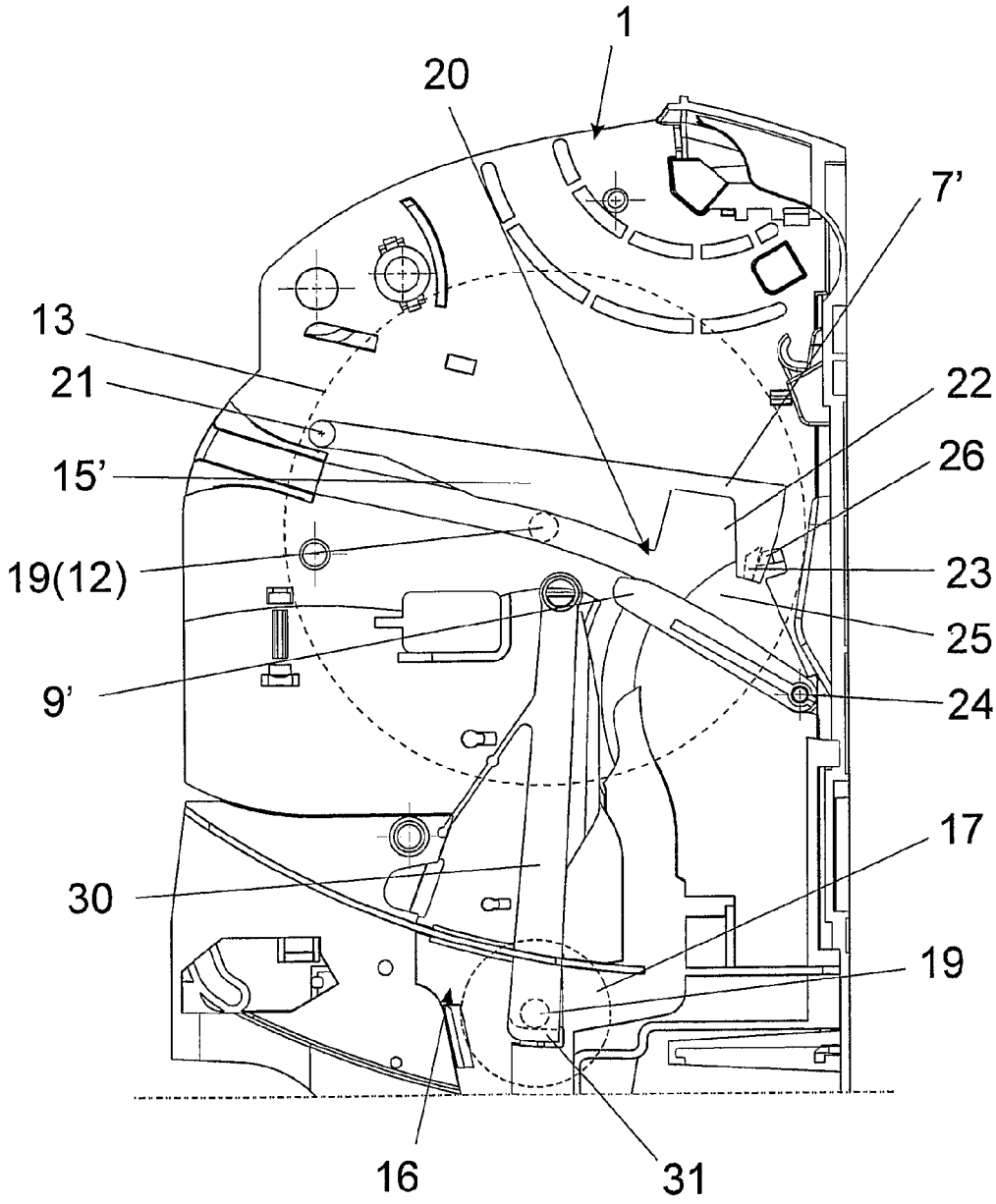
FIG. 8 is a diagrammatic, side view of an upper region of the side wall from FIG. 7 with a schematically inserted spare roll, similar to FIG. 1.

In the embodiment according to FIGS. 7 to 11, the registration of the diameter of the spare roll 13 and the release of the blocking device 9' are not carried out by a sensing element pressing directly against the circumference of the spare roll 13 but by a sensing element 15' which can likewise be pivoted and which rests on one of the two bearing journals 19 sliding or rolling in the grooves of the guide track 11. As can be seen from FIGS. 7 to 11, the sensing element 15' extends above the first section of the guide track 11, which falls slightly rearward, and is mounted such that it can pivot about an axis 21. The sensing element 15' engages in the guide track 11 and is raised by the bearing journals 19 of the spare roll 13 when the latter is inserted into the paper dispenser. As FIG. 8 shows, in the waiting position the spare roll 13 rests on the rear wall of the housing 1 before the bearing journal 19 comes to lie above the section of the guide track 11 that continues downward. The sensing element 15' has a control part 7' projecting in the manner of a hook, on which a blocking projection 23 is formed.

Paper is dispensed as required from the dispenser roll 17 lying in its lower dispensing position, which roll rests with a bearing journal 19 on a bearing lug 31 that can be pivoted out. Once the paper from the dispenser roll 17 has been used up, paper from the spare roll 13 in the waiting position is gripped and output by a non-illustrated device. Transfer devices 18 needed for this purpose (FIG. 7) are known in various embodiments and belong to the general prior art, so that it is not necessary to discuss them in more detail here. They are not important to the understanding of the invention treated here.

Figure 9:
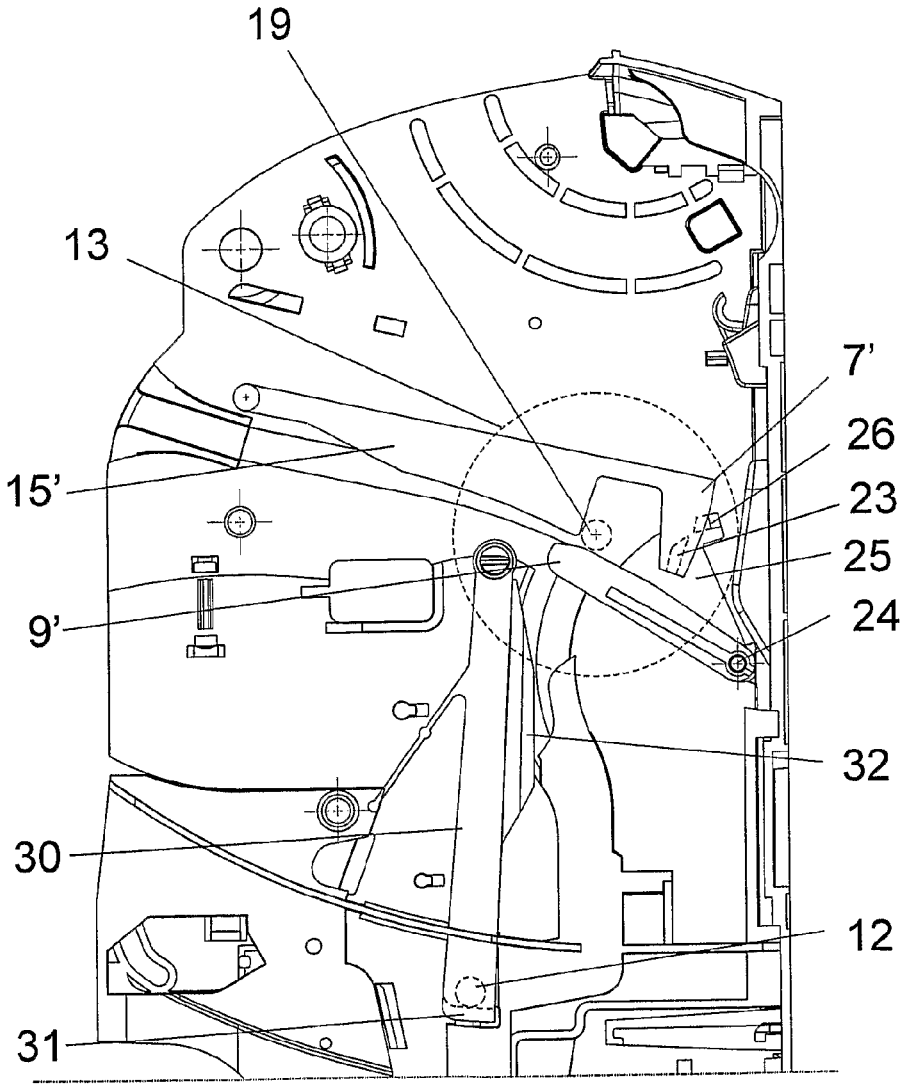
FIG. 9 is a diagrammatic, side view of the upper region of the side wall from FIG. 7 with the waiting position for the reduced size spare roll already unlocked, similar to FIG. 5.

Dispensing the paper from the spare roll 13 leads to a reduction in the diameter, and the roll carrier 12 or the bearing journal 19 come closer to the region of the section leading downward, until the position shown in FIG. 9 is reached, which represents the end of the waiting position and in which the bearing journal 19 has entered the release position 22 of the control part 7'.

The blocking element 9', which can be pivoted downward about the axis 24, engages in both guide tracks 11 and blocks both bearing journals 19, has a side part 25, on which there is provided a stop 26 interacting with the blocking projection 23.

Figure 10:
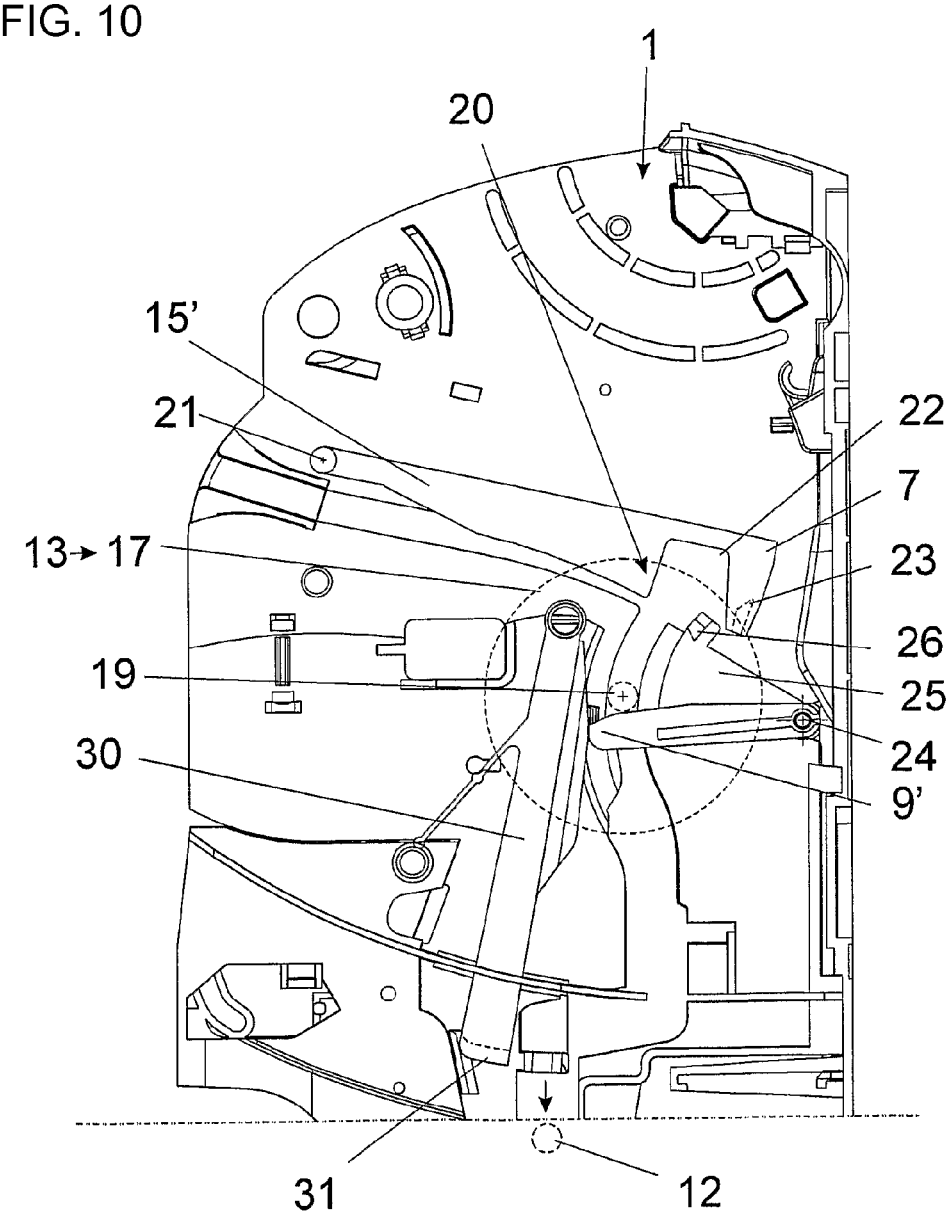
FIG. 10 is a diagrammatic, side view of the upper region of the side wall from FIG. 7, the spare roll having moved downward part of the way.
Figure 11:
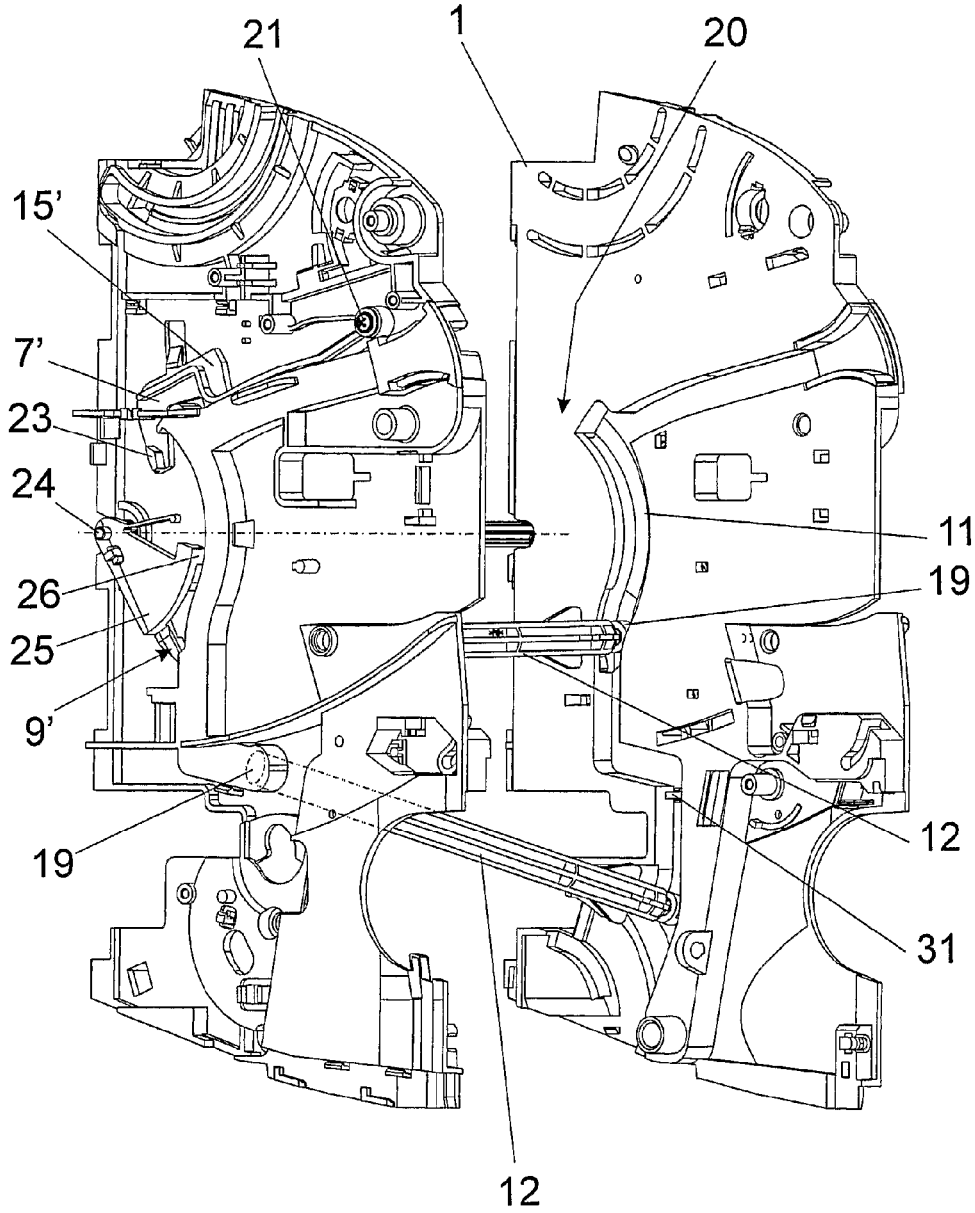
FIG. 11 is a diagrammatic, perspective view of the two side walls with the two roll carriers in the positions according to FIG. 10.

In the position according to FIG. 9, the blocking projection 23 has been lowered together with the sensing element 15', so that the stop 26 is free and can pivot downward with the blocking element 9'. FIG. 10 shows a position of the individual elements at about half the pivoting travel. The bearing lug 31 mentioned above has on its swinging arm 30 a lateral elevation 32, onto which the blocking element 9' runs, the empty roll carrier 12 of the dispenser roll 17 that has been used up losing its support, so that it is able to tilt downward, as can be seen from FIG. 11, and slips out of the opposite guide track 11. As the blocking element 9' is pivoted further downward, the bearing lug 31 returns into its position and is once more able to support the spare roll 13 slipping down, which therefore becomes the new dispenser roll 17.

Then, the blocking element 9' is repositioned in the position according to FIG. 9 by a non-illustrated spring, so that when a new spare roll 13 is inserted, the control part 7', which, according to FIG. 8, has been raised again with the sensing element 15', once more defines the waiting position, since the stop 26 is blocked by the blocking projection 23.

The invention claimed is:

1. A paper dispenser for dispensing paper, comprising:
a housing;
a receiving compartment for a dispenser roll disposed in said housing;
a guide track leading from above into said receiving compartment for a spare roll to be moved from an upper waiting position into said receiving compartment, said guide track disposed in said housing;
said upper waiting position being delimited by a narrow passage sized for allowing the spare roll to move into said receiving compartment only after the diameter of the spare roll has been reduced, said narrow passage disposed in said housing; and
a device disposed in said housing for transferring the paper from the spare roll, which is dispensed once the dispenser roll has been used up, said narrow passage maintaining said waiting position of the spare roll as a diameter of the spare roll is reduced by dispensing the paper before moving the spare roll to said receiving compartment.

2. The paper dispenser according to claim 1, further comprising a blocking device disposed in said narrow passage, said blocking device is released only when a diameter of the spare roll has been reduced below a width of said narrow passage.

3. The paper dispenser according to claim 2, further comprising a movable sensing element for the spare roll, said movable sensing element is coupled to said blocking device.

4. The paper dispenser according to claim 3, wherein said guide track has mutually opposite grooves formed therein, the spare roll and the dispenser roll each have a roll carrier with bearing journals at ends of said roll carrier projecting into said mutually opposite grooves, said blocking device being assigned to both of said mutually opposite grooves.

5. The paper dispenser according to claim 4, wherein said blocking device has a slider with an end which projects into said guide track and is drawn back by said movable sensing element.

6. The paper dispenser according to claim 4, wherein said blocking device is a swinging arm that can be moved downward, said swinging arm has an end projecting into said guide track and is released by said movable sensing element.

7. The paper dispenser according to claim 6, wherein in the waiting position, a circumferential surface of the spare roll rests on a part of said housing, and said movable sensing element is assigned to at least one of the bearing journals.

8. The paper dispenser according to claim 3, wherein said movable sensing element rests on a circumferential surface of the spare roll.

9. The paper dispenser according to claim 3, further comprising a lid attached to said housing and can be pivoted up, said movable sensing element can be pivoted up into a refilling position together with said lid.

10. A paper dispenser, comprising:
a receiving compartment for receiving a dispenser roll;
a blocking device;
a guide track leading from above into said receiving compartment, in said guide track, a waiting position for a spare roll being defined by said blocking device, said receiving compartment having a width smaller than a diameter of the spare roll;
a device for transferring paper from the spare roll after the paper from the dispenser roll has been used up, said blocking device maintaining said waiting position of the spare roll as a diameter of the spare roll is reduced by dispensing the paper before moving the spare roll to said receiving compartment; and
a sensing element for sensing the diameter of the spare roll, said sensing element releasing said blocking device only when the diameter of the spare roll has been reduced to the width of said receiving compartment by dispensing the paper.

* * * * *